US005636602A

United States Patent [19]

Meister

[11] Patent Number: 5,636,602

[45] Date of Patent: Jun. 10, 1997

[54] PUSH-PULL VALVE ASSEMBLY FOR AN ENGINE CYLINDER

[75] Inventor: Steven F. Meister, Chillicothe, Ill.

[73] Assignee: Caterpillar Inc., Peoria, Ill.

[21] Appl. No.: 636,619

[22] Filed: Apr. 23, 1996

[51] Int. Cl.[6] ..... F01L 9/02; F01L 1/26; F01L 1/18

[52] U.S. Cl. ..... 123/90.12; 123/90.22; 123/90.4; 123/188.8

[58] Field of Search ..... 123/90.11, 90.12, 123/90.13, 90.22, 90.23, 90.24, 90.39, 90.4, 90.65, 86, 188.8

[56] References Cited

U.S. PATENT DOCUMENTS

| | | | |
|---|---|---|---|
| 3,168,083 | 2/1965 | Buchanan | 123/90.24 |
| 3,361,121 | 1/1968 | Schott | 123/90.13 |
| 3,978,826 | 9/1976 | Gavrun et al. | 123/90.12 |
| 4,485,780 | 12/1984 | Price et al. | 123/321 |
| 4,572,114 | 2/1986 | Sickler | 123/21 |
| 4,593,662 | 6/1986 | Baring et al. | 123/90.39 |
| 4,716,862 | 1/1988 | Sauro | 123/90.12 |
| 4,741,307 | 5/1988 | Meneely | 123/90.12 |
| 4,977,869 | 12/1990 | Fayard | 123/90.24 |
| 5,197,419 | 3/1993 | Dingess | 123/90.13 |
| 5,231,959 | 8/1993 | Smietana | 123/90.12 |
| 5,233,951 | 8/1993 | Hausknecht | 123/90.12 |
| 5,237,968 | 8/1993 | Miller et al. | 123/90.11 |
| 5,237,976 | 8/1993 | Lawrence et al. | 123/508 |
| 5,363,816 | 11/1994 | Yorita et al. | 123/90.12 |
| 5,373,817 | 12/1994 | Schechter et al. | 123/90.12 |
| 5,421,359 | 6/1995 | Meister et al. | 137/12 |
| 5,499,606 | 3/1996 | Robnett et al. | 123/90.12 |
| 5,522,358 | 6/1996 | Clarke | 123/188.8 |

*Primary Examiner*—Weilun Lo
*Attorney, Agent, or Firm*—Liell & McNeil

[57] ABSTRACT

A push-pull valve assembly for an engine cylinder includes an engine defining a gas passageway in fluid communication with a hollow piston cylinder via a first opening and a second opening. An inward valve seat is positioned in the first opening adjacent the hollow piston cylinder. An outward valve seat is positioned in the second opening adjacent the gas passageway. A first valve member has a first stem and a first enlarged portion with an inward valve face positioned in the hollow piston cylinder. A second valve member has a second stem and a second enlarged portion with an outward valve face position in the gas passageway. The first valve member and the second valve member are operably coupled via a mechanical or hydraulic linkage. A spring is utilized to bias the inward valve face against the inward valve seat to close the first opening and the outward valve face against the outward valve seat to close the second opening.

13 Claims, 2 Drawing Sheets

PUSH-PULL VALVE ASSEMBLY FOR AN ENGINE CYLINDER

TECHNICAL FIELD

The present invention relates generally to valve assemblies for engine cylinders, and more particularly to a coupled push-pull valve assemblies for the cylinders of a diesel engine.

BACKGROUND ART

Current diesel engine valves open into the cylinder to provide air for combustion or to released exhaust gas after combustion. Most engine valves open into the cylinder and are timed either mechanically or electronically to avoid contact with the reciprocating piston that is moving up and down within the piston cylinder. These inward opening valves have the advantage of good sealing characteristics because, as cylinder pressures rise during combustion, the valve tends to seal more tightly against its seat because of the differential pressure on each side of the valve. The disadvantage, however, is that any mistiming of the valve opening event invites undesirable and potentially catastrophic valve to piston contact. This is due to the fact that both the piston and the valve member have the potential to attempt to occupy the same space at the same time.

Another disadvantage of prior art inward opening valves is their actuators and biasing springs tend to occupy a significant amount of space above the engine cylinder, leaving a relatively small envelope of space within which to position a fuel injector. Another disadvantage often encountered in these inward type opening valves of the prior art is that the biasing springs used to bias the valve to a closed position are often relatively strong. This requires a significant amount of energy and a powerful actuator to open each individual valve. This consequence in turn inhibits movement away from cam driven valves to a more desirable electronically actuated valving system.

The present invention is intended to alleviate these and other problems associated with the inward opening valving assemblies of the prior art.

DISCLOSURE OF THE INVENTION

In responding to the problems associated with the prior art, the present invention provides a push-pull valve assembly for an engine cylinder. The assembly includes an engine defining a gas passageway in fluid communication with a hollow piston cylinder via a first opening and a second opening. An inward valve seat is positioned in the first opening adjacent the hollow piston cylinder. An outward valve seat is positioned in the second opening adjacent the gas passageway. A first valve member has a first stem and a first enlarged portion with an inward valve face positioned in the hollow piston cylinder. A second valve member has a second stem and a second enlarged portion with an outward valve face positioned in the gas passageway. Some means, such as a mechanical or hydraulic linkage, is provided to operably connect the first stem and the second stem so that the first valve member is coupled to the second valve member. Finally, some means, such as a spring, is provided to bias the inward valve face against the inward valve seat to close the first opening and the outward valve face against the outward valve seat to close the second opening.

One object of the present invention is to reduce the power required to actuate the valves to open against cylinder pressure.

Another object of the present invention is to increase the available space above an engine cylinder for a fuel injector.

Still another object of the present invention is to avoid valve to piston contact due to a mistimed valve opening event.

Another object of the present invention is provide improved valve assemblies for engine cylinders.

BEST MODE FOR CARRYING OUT THE INVENTION

Figure 1:
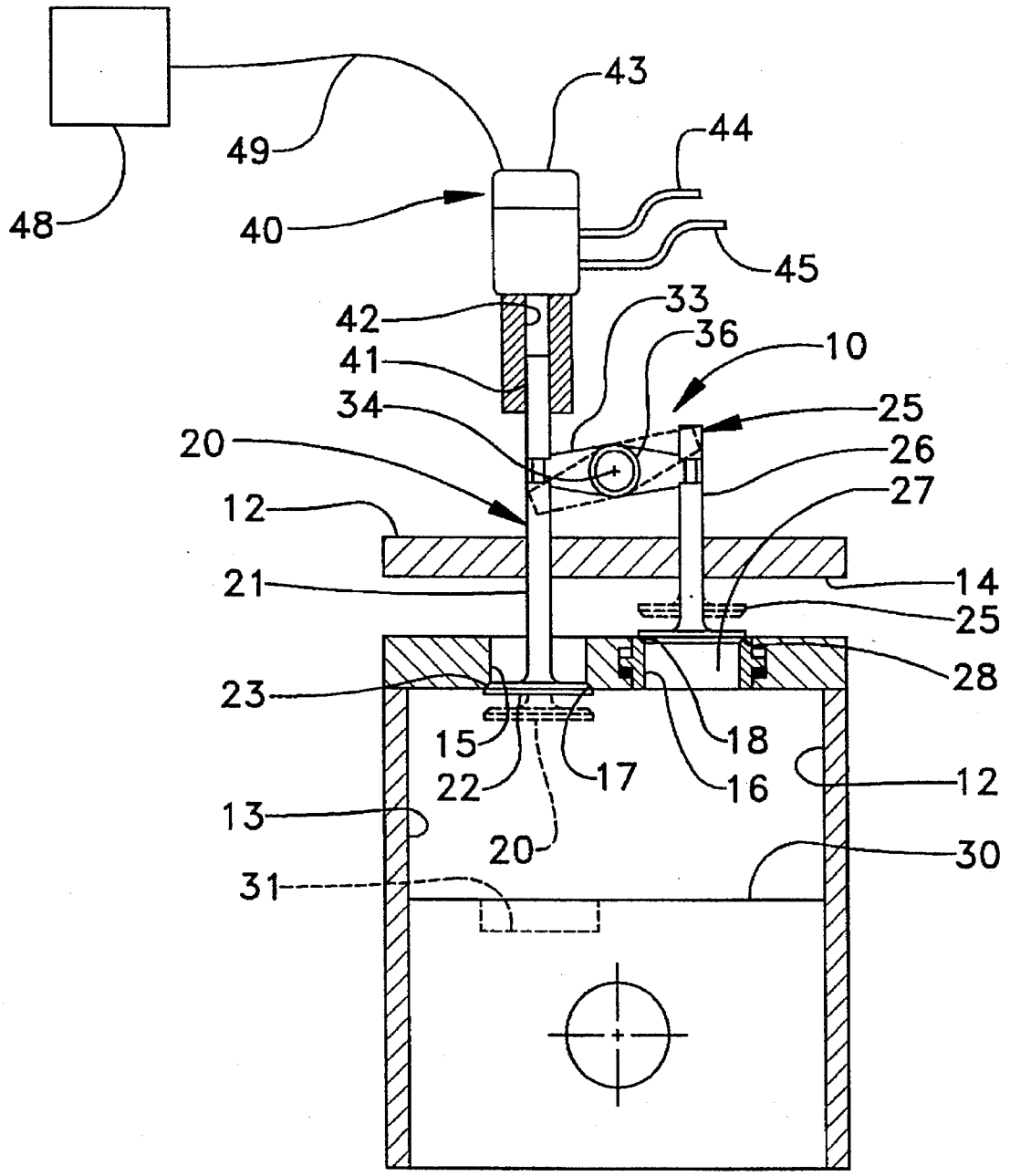
FIG. 1 is a sectioned side elevational view of a push-pull valve assembly for an engine cylinder according to one embodiment of the present invention.

Referring now to FIG. 1, a push-pull valve assembly 10 is mounted to an engine 12, which has a hollow piston cylinder 13 in fluid communication with a gas passageway 14 via a first opening 15 and a second opening 16. Gas passageway 14 could either be an air supply passage to or an exhaust gas passageway from hollow piston cylinder 13. A portion of the first opening 15 adjacent hollow piston cylinder 13 is formed into an annular shaped inward facing valve seat 17. A portion of second opening 16 adjacent gas passageway 14 is formed into an annular shaped outward valve seat 18.

A first valve member 20 has a first stem 21 and a first enlarged portion 22 that is positioned within hollow piston cylinder 13. First enlarged portion 22 includes an annular shaped inward valve face 23 that closes first opening 15 when seated against inward valve seat 17. A second valve member 25 has a second stem 26 and a second enlarged portion 27 that is positioned in gas passageway 14. Enlarged portion 27 is formed to include an annular shaped valve face 28 that closes second opening 16 when seated against outward valve seat 18, which is machined as part of a floating valve seat mounted in the opening.

First valve member 20 is coupled to second valve member 25 via a rocker arm 33 that has one arm attached to first stem 21 and its opposing arm attached to second stem 26. Rocker arm 33 is mounted to pivot about a pivot point 34. The term "coupled" is intended to mean that one member moves as a function of the distance moved by the other member due to a physical linkage between the valve stems. The function is preferably linear so that the relative movement is in a constant proportion. In the case of push-pull valve assembly 10 shown in FIG. 1, the constant proportion is a one to one relationship because both valve stems 21 and 26 are located an equal distance away from pivot point 34. A torsional spring 36 is mounted about pivot point 34 and serves to bias rocker arm 33 to the horizontal position shown so that first valve member 20 and second valve member 25 close first opening 15 and second opening 16, respectively.

Although the push-pull valve assembly 10 of the present invention could be actuated by a cam mechanically driven directly by the engine, the present invention finds its most preferably application in an electronically controlled system that allows the valve's timing to be controlled independently of engine crankshaft position. In this case, an actuator 40 includes a hydraulic plunger 41 with one end connected to first stem 21 of first valve member 20 and its other end exposed to a hydraulic actuation cavity 42. An electronic solenoid controlled valve 43, of a type known in the art, alternately opens hydraulic actuation cavity 42 to a high pressure fluid supply inlet 44 or a low pressure fluid drain 45. Hydraulic actuator 40 preferably utilizes lubricating oil as its hydraulic medium, in the same manner that hydraulically actuated fuel injectors of the type manufactured by Caterpillar Inc. utilize engine lubricating oil as their hydraulic medium.

The engine computer 48 communicates with solenoid 43 via a link 49 which allows the computer to control solenoid 43 by energizing and de-energizing the same. In this example, when solenoid 43 is energized, high pressure hydraulic fluid flows through inlet 44 into cavity 42 causing hydraulic plunger 41 to be pushed downward. This action in turn causes first valve member 20 to move downward to open first opening 15. Due to the coupling of first valve member 20 to second valve member 25 via rocker arm 33, the second valve member 25 lifts off its seat to open second opening 16. When computer 48 de-energizes solenoid 43, cavity 42 is opened to low pressure drain 45 and torsional spring 36 causes valve members 20 and 25 to return to their closed position as shown.

Because the coupled valve members of the present invention would typically replace a single valve member of the prior art, the valves of the present invention can open a shorter distance than the prior art while still providing an adequate flow area between hollow piston cylinder 13 and gas passageway 20 14. Thus in many instances the inward opening valve member 20 can be engineered to move only a slight distance into hollow piston cylinder 13, and preferably such a distance is sufficiently small that it is impossible for the cylinder 30 and the enlarged head portion 22 of valve member 20 to come into contact. In some instances it will be necessary to machine a shallow depression 31 in the top surface of piston 30 in order to provide adequate clearance for inward opening valve member 20 in order to insure that the possibility of piston to valve contact is eliminated. Those skilled in the art will appreciate that under no circumstances would it be possible for the outward opening valve member 25 to come in contact with piston 30.

Figure 2:
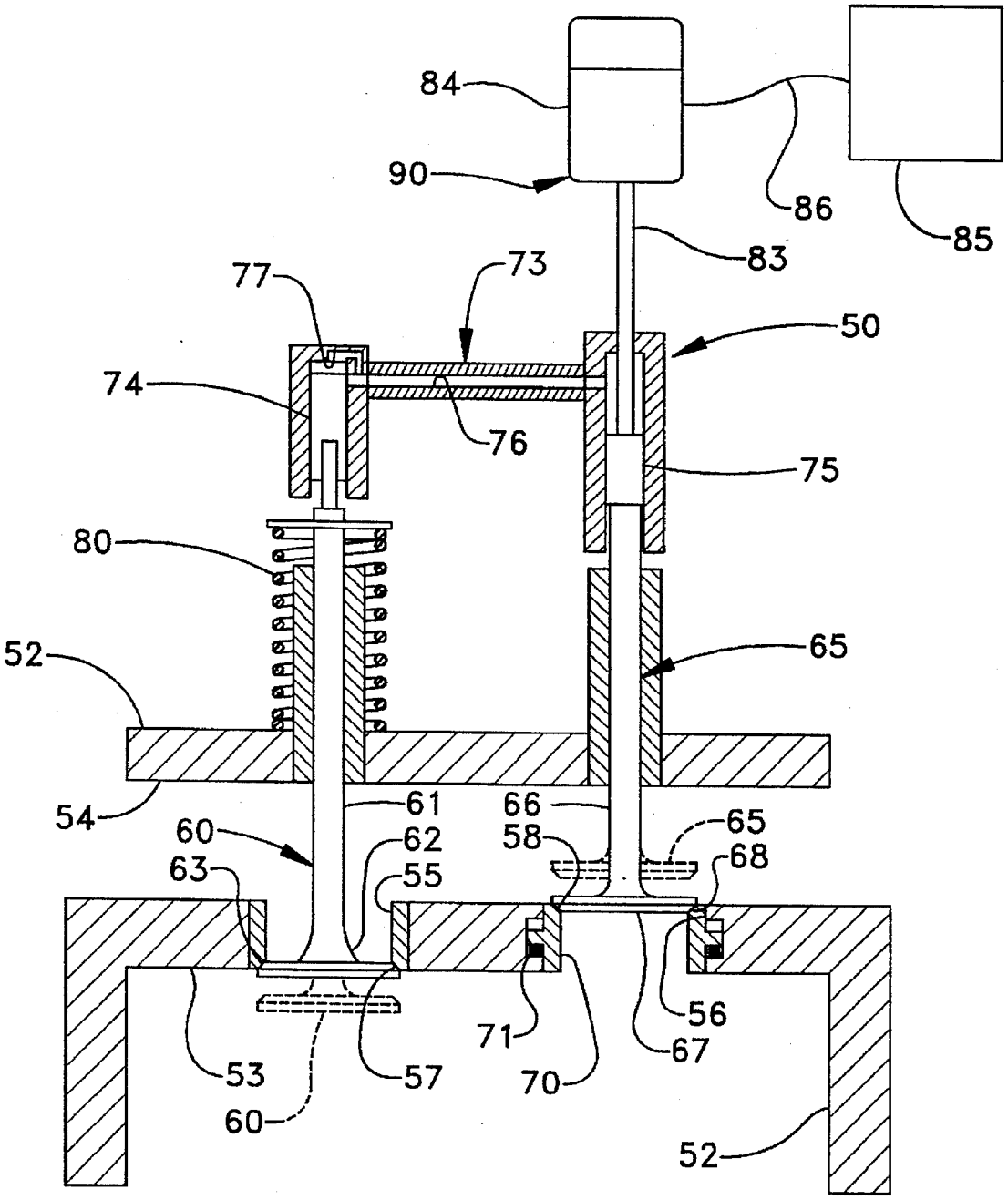
FIG. 2 is a sectioned side elevational view of a push-pull valve assembly for an engine cylinder according to another embodiment of the present invention.

Referring now to FIG. 2, a push-pull valve assembly 50 according to another embodiment of the present invention is illustrated. Like the earlier embodiment, assembly 50 is mounted to an engine 52 that defines a hollow piston cylinder 53 that is in fluid communication with a gas passageway 54 via a first opening 55 and a second opening 56. First opening 55 is machined to include an annular shaped inward valve seat 57. A floating valve member 70 is mounted in second opening 56 and is biased via a spring 71 to a position away from hollow piston cylinder 53. Floating valve member 70 is machined to include an annular shaped outward valve seat 58. Floating valve member 70 is the means by which the valve assembly of the present invention accommodates for thermal growth and wear of the valve seating areas. The floating valve member causes outward valve seat 58 to float up and down above hollow piston cylinder 53. Pressure within hollow piston cylinder 53 pushes floating valve member 70 up against outward opening valve member 65 to insure proper closure of second opening 56.

A first inward opening valve member 60 includes a first stem 61 and an enlarged portion 62 that is positioned within hollow piston cylinder 53. A section of enlarged portion 62 is machined to include an annular shaped inward valve seat 63 that closes first opening 55 when seated against inward valve seat 57. An outward opening valve member 65 includes a second stem 66 and an enlarged portion 67 that is positioned within gas passageway 54. Enlarged portion 67 is machined to include an annular shaped valve face 68 that closes second opening 56 when seated against outward valve seat 58.

Inward opening valve member 60 and outward opening valve member 65 are coupled to one another via a hydraulic linkage 73. Hydraulic linkage 73 includes a first hydraulic plunger 74 with one end connected to first stem 61 and its other pressure face end exposed to fluid pressure in hydraulic cavity 76. A hydraulic snubber 77, of a type known in the art, can be included to control the sealing velocity of inward opening valve member 60. Linkage 73 also includes a second hydraulic plunger 75 with one end attached to second stem 66 and its other end exposed to hydraulic fluid cavity 76. Because the fluid volume within cavity 76 is relatively fixed, any upward movement of second hydraulic plunger 75 necessarily causes downward movement in first hydraulic plunger 74, and vice versa. While the movement of valve members 60 and 65 are coupled through hydraulic linkage 73, the movement ratio between the two valve members can be controlled by engineering the relative sizes of hydraulic plungers 74 and 75. In other words, if the hydraulic plungers 74 and 75 have identical displacements, the movement of the valve members will be in direct one-to-one proportion. Those skilled in the art will appreciate that any desired relative movement ratio can be engineered by controlling the relative displacement volumes of hydraulic plunger 74 and 75. This control is similar to the counterpart of that shown in FIG. 1 where the relative movement of the two valves was controlled by the length of the opposing arms in the rocker arm assembly.

An actuator 90 includes a solenoid 84 which is operably connected to second hydraulic plunger 75 via a rod 83. A computer 85 communicates with and controls solenoid 84 via a communication link 86. When solenoid 84 is energized, rod 83 lifts hydraulic plunger 75 causing second valve member 65 to lift off its seat. At the same time, fluid displacement within hydraulic cavity 76 causes first hydraulic plunger 74 to move downward causing inward opening valve member 60 to move off its seat, as shown in shadow. When solenoid 84 is de-energized, a return coil compression spring 80 pushes valve member 60 toward its closed position. This in turn causes displacement of the first hydraulic plunger 74, which again hydraulically pushes second hydraulic plunger 75 to close outward opening valve member 65.

Industrial Applicability

Those skilled in the art will appreciate that the present invention provides several degrees of freedom that will allow the push-pull valve assembly of the present invention to be engineered to virtually any engine cylinder valving requirements. For instance, as in the prior art, a pressure differential between hollow piston cylinder 13 and gas passageway 14 can be exploited to hold valve members 20 and 25 against their respective seats, to avoid undesirable leakage. One way of insuring this proper valve closure would be to engineer the effective area of first enlarged portion 22 to be larger than the effective exposed area of second enlarged portion 27. In this way, the force tending to close first valve member 20 would be greater than the force tending to open outward opening valve member 25. This could also be accomplished by engineering the rocker arm such that valve member 20 is farther away from pivot point 34 than valve member 25. In this way, any upward force on valve member 20 would create a greater torque about pivot point 34 than any counter torque produced by an upward force on second valve member 25. These two degrees of freedom would allow an engineer to minimize the distance at which inward opening valve member 20 must protrude into hollow piston cylinder 13 while insuring proper valve closures during combustion and adequate flow areas when the valves are opened.

By balancing one valve member against the other valve member, the assembly can be engineered to require a relatively small actuation force to move the valves to an open position. This enables the push-pull valve assembly to exploit an actuator technology developed in relation to hydraulically actuated fuel injectors, such as those of the type manufactured by Caterpillar, Inc. This pressure balancing ability also results in the need for a relatively weak biasing spring to bias the valves to a closed position. Thus, the valve assembly can be biased closed and actuated to an open position with relatively smaller and weaker components than those required of the prior art. This in turn will allow the available envelope of space for a fuel injector to be enlarged. This enlarged available space for a fuel injector can in turn allow improvements to be incorporated in the fuel injectors that might otherwise be impossible in the constrained space availability of the prior art.

While the present invention has been illustrated in two separate embodiments, one showing a mechanical linkage coupling the first valve member to the second valve member and the other showing a hydraulic linkage, virtually any suitable linkage of the type known in the art could be incorporated and used in the present invention. Furthermore, those skilled in the art will appreciate that the push-pull valve assembly of the present invention could be actuated by any one of several methods known in the art, such as hydraulically, via a solenoid, or even by a prior art cam driven mechanical system. In any event, the above description is intended for illustrative purposes only and is not intended to limit the scope of the invention in any way. The intended scope of the present invention should be interpreted from the claims as set forth below:

I claim:

1. A push pull valve assembly for an engine cylinder comprising:

an engine defining a gas passageway in fluid communication with a hollow piston cylinder via a first opening and a second opening;

an inward valve seat positioned in said first opening adjacent said hollow piston cylinder;

an outward valve seat positioned in said second opening adjacent said gas passageway;

a first valve member having a first stem and a first enlarged portion with an inward valve face positioned in said hollow piston cylinder;

a second valve member having a second stem and a second enlarged portion with an outward valve face positioned in said gas passageway;

means, operably connecting said first stem and said second stem, for coupling said first valve member and said second valve member; and means for biasing said inward valve face against said inward valve seat to close said first opening and said outward valve face against said outward valve seat to close said second opening.

2. The push pull valve assembly of claim 1 further comprising:

an actuator operably connected to one of either said first stem or said second stem and being capable of moving from a first position to a second position when actuated;

said inward valve face being away from said inward valve seat to open said first opening and said outward valve face being away from said outward valve seat to open said second opening when said actuator is in said second position; and a computer in communication with said actuator and being capable of controlling said actuator to move from said first position to said second position.

3. The push pull valve assembly of claim 2 wherein said means for biasing is a spring.

4. The push pull valve assembly of claim 3 wherein said means for coupling includes a mechanical linkage interconnecting said first stem and said second stem.

5. The push pull valve assembly of claim 4 wherein said mechanical linkage includes a rocker arm pivotably mounted on said engine at a pivot, and having a first arm attached to said first stem and a second arm attached to said second stem.

6. The push pull valve assembly of claim 5 wherein said spring is a torsional spring mounted about said pivot in contact with said rocker arm.

7. The push pull valve assembly of claim 6 wherein said actuator includes a hydraulic plunger attached to one of either said first stem or said second stem.

8. The push pull valve assembly of claim 2 wherein said outward valve seat is a portion of a floating valve member that is mounted in said second opening;

said floating valve member being movable between a first position and a second position that is further away from said hollow piston cylinder; and means, mounted between said floating valve member and said engine, for biasing said floating valve member toward said second position.

9. The push pull valve assembly of claim 3 wherein said means for coupling includes a hydraulic linkage interconnecting said first stem and said second stem.

10. The push pull valve assembly of claim 9 wherein said hydraulic linkage includes a first hydraulic plunger attached to said first stem, a second hydraulic plunger attached to said second stem and a hydraulic connection extending between said first hydraulic plunger and said second hydraulic plunger.

11. The push pull valve assembly of claim 10 wherein said spring is a coil spring compressed between said engine and said first valve member.

12. The push pull valve assembly of claim 11 wherein said actuator is attached to one of either said first hydraulic plunger or said second hydraulic plunger.

13. The push pull valve assembly of claim 12 wherein said outward valve seat is a portion of a floating valve member that is mounted in said second opening;

said floating valve member being movable between a first position and a second position that is further away from said hollow piston cylinder; and means, mounted between said floating valve member and said engine, for biasing said floating valve member toward said second position.

* * * * *